United States Patent [19]

Reed, 3rd et al.

[11] 3,992,736

[45] Nov. 23, 1976

[54] EXPANDABLE ELEMENT CHECK VALVE

[75] Inventors: Edgar A. Reed, 3rd, Ambler; Kenneth T. Koper, Philadelphia; Dennis H. Vaders, Warminster, all of Pa.

[73] Assignee: The United States of America as represented by the Secretary of the Navy, Washington, D.C.

[22] Filed: Dec. 22, 1975

[21] Appl. No.: 642,938

[52] U.S. Cl. ..... 9/8 R; 137/78; 340/2

[51] Int. Cl.[2] ..... B63B 21/52

[58] Field of Search ..... 9/8 R; 340/2; 244/142, 244/145; 137/78, 67, 55, 199

[56] References Cited

UNITED STATES PATENTS

| | | | |
|---|---|---|---|
| 2,577,337 | 12/1951 | Lancaster | 137/78 |
| 2,895,493 | 7/1959 | Edwards | 137/78 |
| 3,204,872 | 9/1965 | Whear | 137/78 |
| 3,448,689 | 6/1969 | Caldwell | 137/78 |
| 3,889,224 | 6/1975 | Reed et al. | 9/8 R |

*Primary Examiner*—Trygve M. Blix
*Assistant Examiner*—Stuart M. Goldstein
*Attorney, Agent, or Firm*—R. S. Sciascia; Henry Hansen; William J. iseman

[57] ABSTRACT

A check valve is secured to the base of an air deployable ram-air inflatable bag attached in the crown of a parachute or decelerator. Upon descent, air is forced through an orifice in the valve thereby opening a flapper and inflating the bag while decelerating the downward velocity of a sonobuoy attached to the decelerator. Upon water entry, water flows into the bag and expands a sponge positioned in the valve thereby forcing the flapper against the orifice and preventing the escape of trapped air from the bag during low frequency vertical oscillation in a static floating position.

11 Claims, 4 Drawing Figures

EXPANDABLE ELEMENT CHECK VALVE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to fluid check valves and particularly to a buoy decelerator check valve which opens in response to air pressure and which closes when in contact with water.

In the air-to-sea launched ram-air inflated floatation devices described in the prior art a problem is encountered in maintaining the buoyancy of the device during high frequency vertical oscillation in the water. Once inflated, air must be retained within the floatation member to maintain sufficient buoyancy to support the buoy during deployment in the water. One prior art device disclosed in U.S. Pat. No. 3,889,224 to Reed et al. reveals a ram-air inflatable decelerator apparatus in which the air opening is unrestricted, allowing a sufficient amount of air to enter and inflate the member during descent and also a quantity of water to enter and seal the orifice during deployment. However, during low frequency oscillations of the member, such as in heavy seas of the order of magnitude of International sea state 5, the water level within the member becomes tenuous and may at times fall aside or below the air opening, allowing air to escape from the member and causing it to deflate.

SUMMARY OF THE INVENTION

Accordingly, it is an object of the present invention to provide a floatation check valve which is positively actuated upon contact with water. Another object of the invention is to provide a force element within the check valve which expands in size upon water contact. A further object of the present invention is to provide a floatation check valve having a sufficiently large orifice to allow enough forced air to enter the inflatable member during descent.

Briefly, these and other objects are accomplished by a check valve secured to the base of an air deployable ram-air inflatable bag attached to the crown of a parachute or decelerator. Upon descent, air is forced through a sufficiently large orifice in the valve thereby opening a flapper plate hinged thereto and inflating the bag while decelerating the downward velocity of the sonobuoy attached to the decelerator. Upon water entry, water flows into the bag causing a celluloid sponge element attached in the valve to expand and thereby force the flapper plate to close the orifice and prevent the escape of air from the bag during oscillation in the water.

For a better understanding of these and other aspects of the invention, reference may be made to the following detailed description taken in conjunction with the accompanying drawings.

DESCRIPTION OF THE PREFERRED EMBODIMENT

Figure 1:
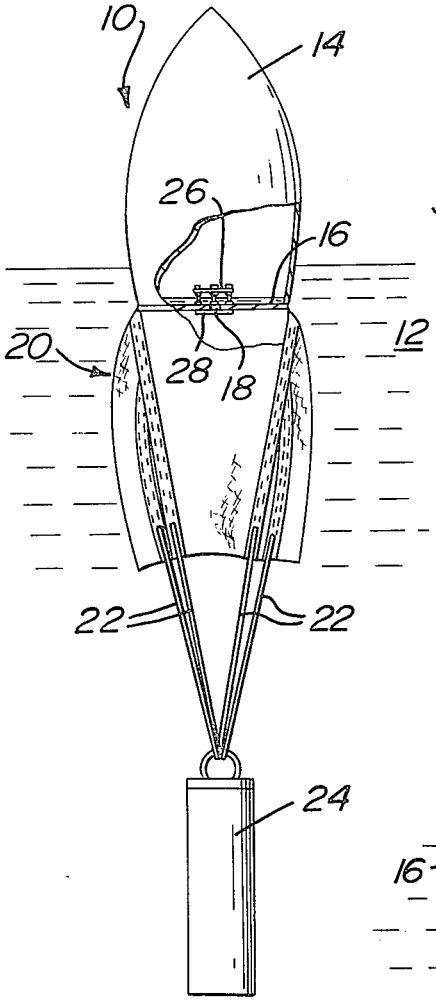
FIG. 1 is a partially cutaway pictorial representation in elevation of the present invention housed in a floatation unit and resting in water.

Referring now to FIG. 1, there is shown a floatation unit 10 buoyantly supported in a body of water 12 at its approximate floatation height. The unit 10 includes an inflatable, non-porous bag 14 having a non-permeable bottom panel 16 attached to the open end of the bag 14 with an orifice 18 therethrough. Floatation unit 10 is attached, such as by sewing, to the crown portion of a decelerator or parachute 20. The parachute 20 is attached by means of a plurality of shroud lines 22 to a sonobuoy 24 suspended therefrom. A check valve 26, including a bottom plate 28 which will be described with further detail hereinafter, is attached in coaxial alignment with the orifice 18 in the bottom panel 16. The plate 28 is preferably attached to the underside of the panel 16 by a sealant such as a waterproof glue. The outer edge of the panel 16 may be attached to the inner wall of the buoy 14 in any convenient manner such as by glueing. Alternatively, the exposed bottoms of the panel 16 and the plate 28 may be sealingly attached to a support panel which can be glued to the bag 14. The support panel will have an opening to mate with the orifice 18 and will more effectively seal the plate 28 against water leakage.

Figure 2:
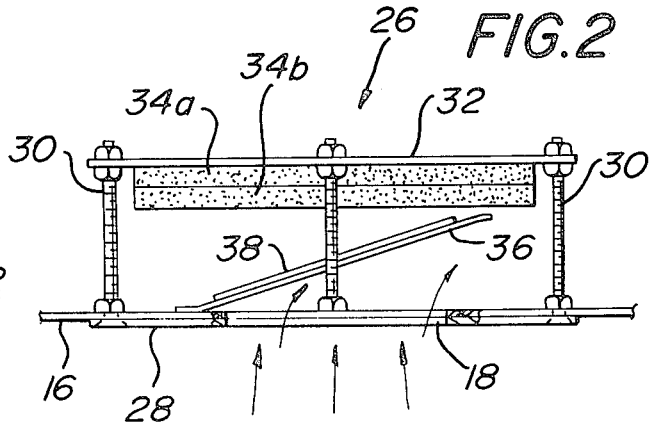
FIG. 2 is a side elevation view of the invention shown in the open position.

Referring now to FIG. 2, the valve 26 is shown in an open position. The bottom plate 28 of the valve is circular having an opening in the center thereof of a similar size to the orifice 18 and is concentrically aligned therewith. The plate 28 is aligned with and secured to panel 16 by a plurality of conventional spacing assemblies 30, each comprising a threaded screw and associated nuts, circumferentially spaced about the outer portion of the plate 28. Coaxially aligned with the bottom plate 28 and supported at a predetermined distance therefrom by the spacer assemblies 30 is a top plate having a solid circular surface with a diameter similar to that of the bottom plate 28. A pair of dried and compressed celluloid sponges 34 *a*, 34*b*, are attached to the bottom surface of the plate 32 in any convenient manner. The sponges 34 are attached to each other and to the bottom of the plate 32 by an appropriate glue. In conformance with the shape of the upper and lower plates 28, 32 the sponges 34 may also be circular in form but of a sufficiently lesser diameter than either of the plates in order to clear the positioning of the spacers 30. A flexible seal 36, having a diameter greater than that of the orifice 18 and concentrically aligned therewith, is permanently attached at a portion of one side to an area on the top of panel 16 adjacent the orifice. The seal 36 is attached to the panel 16 in any convenient manner such as, for example, an appropriate glue to form a hinge with the panel at the point of attachment. A circular and rigid flapper 38 is concentrically bonded in any conventional manner to the upper surface of the seal 36. The flapper 38 has a diameter which is greater than the diameter of the orifice 18 but which is less than the diameter of the seal 36.

Figure 3:
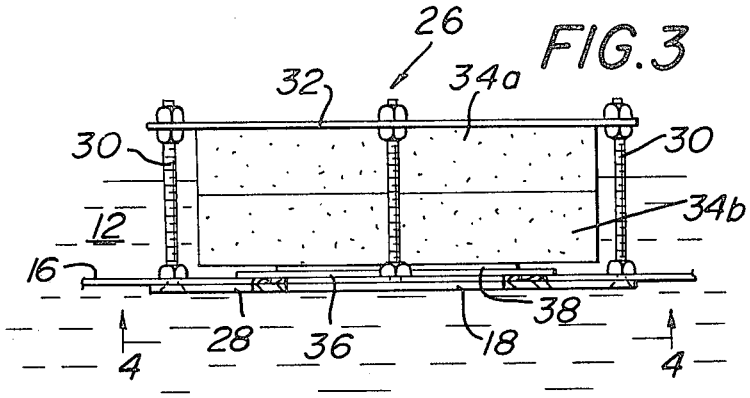
FIG. 3 is a side elevation view of the invention shown in a closed position while deployed in water.

Referring now to FIG. 3, there is shown a side elevational view of the valve 26 closed and partially immersed in water. In this illustration, it is assumed that a certain amount of water 12 has entered the inflatable bag 14 by way of the orifice 18 and the flapper 38. Once having entered the bag, the water 12 ultimately comes in contact with the and the 34*a*, 34*b*, so as to cause the sponges 34 to expand downwardly in a predetermined manner against the flapper 38. The expansive forces produced by the water filled sponges 34 provide sufficient pressures on the flapper 38 so as to cause the flapper and the seal 36 to rotate downwardly in a hinge-like manner ultimately closing the orifice 18 and effectively trapping the air within the bag. The sponges 34, while partially immersed in the water 12, continue to remain expanded thereby permanently closing the valve 26.

Figure 4:
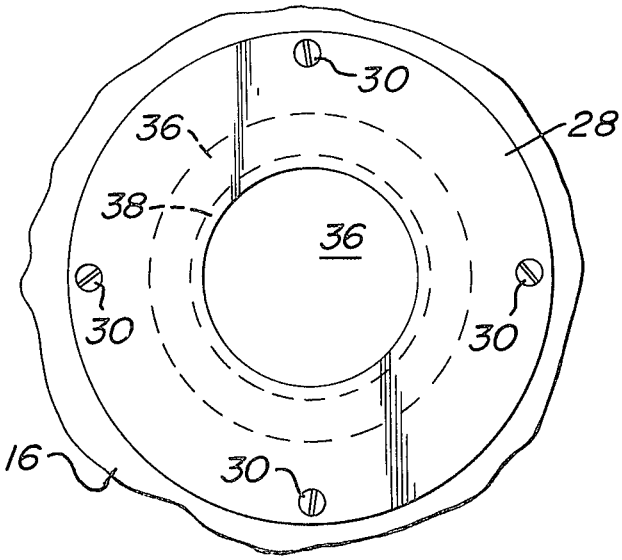
FIG. 4 is a bottom elevation view of the invention shown in FIG. 3.

Referring now to FIG. 4 there is shown a bottom elevation view of the valve 26 as viewed along the lines noted by number 4 in FIG. 3. More clearly shown is the circular bottom plate 28 having a hole at the center thereof which hole is shown covered by a portion of the seal 36 whose outer boundaries are denoted by the larger of the dotted circles. The screwhead portion of the spacers 30 are shown positioned equidistant about the circumference of the plate 28. The outer boundaries of the flapper 38 are designated by the smaller dotted circle and the relative diametrically increasing sizes of the orifice, the flapper 38, the seal 36, and the plate 28, are respectively illustrated.

Design parameters for a typical check valve will now be discussed, by way of example, with relation to a floatation unit supporting a sonobuoy weighing approximately 20–30 pounds. However, the same design principles can be applied for any type or weight of air launched stores. Assuming, that in the present embodiment the height of bag 14 is 20 inches tapering from the top point to a maximum diameter of 10 inches at panel 16, the diameters of the bottom and top plates 28, 32 would be approximately 3.25 inches. Correspondingly, the diameter of the orifice 18 would be approximately 1.5 inches and the distance between the top and bottom plates would be approximately 1 inch. In the dryed compressed state, the sponges 34 would be approximately 0.4–0.3 inches thick when taken together. Necessarily, therefore, the water must rise to a level of approximately 0.6–0.7 inches within the inflated bag 14 in order to contact the sponges 34 to begin the expansion process. The valve, although shown essentially in circular form, may take on any other shape appropriate to its mechanical and fluid environment. The panel 16 and seal 36 may be composed of a tightly woven nylon fabric selected for its strength, and the fabric may further be impregnated or covered with rubber to improve waterproofing and valve sealing effects. The plates 28, 32, spacers 30, and flapper 38 may be made of any rigid material such as metal, polyethylene, or nylon. The sponges 34, although shown as an contiguous pair for better expansion characteristics, may be replaced by a single element exhibiting similar characteristics.

Operation of the check valve will now be described with references to FIGS. 1, 2 and 3. Upon deployment from an aircraft, parachute 20 opens thereby channeling air into the crown portion through metering orifice 18 at a rate approximately equal to that predicted by the continuity equation of fluid mechanics and filling bag 14 to approximately 90% of its total expansible volume. During this time, the flapper 38 is forced open due to the applied air pressure through the orifice 18. The sponges 34, being compressed at this point in the deployment sequence, permit the flapper 38 to hinge in an open position. As the sonobuoy 24 enters the water, the buoyancy and drag of the decelerator combine to prevent the system from being submerged and water pressure collapsing the bag. Water enters the bag 14 through the orifice 18 and valve 26 filling the remaining approximately 10% volume. Upon the water reaching a predetemined level as earlier noted, the sponges 34 begin to expand and force the flapper 38 and attached seal 36 against the orifice thereby effectively sealing the air within the bag. The decelerator is therefore continuously maintained in an erect position providing continuous buoyancy for the sonobuoy 24.

Having thus described the structure and operation of a preferred embodiment, the simplicity and reliability of the present invention should now be readily apparent. More specifically, once immersed in the proper level of water, the expanded sponges continue to exert downward pressure on the flapper 38 so as to keep the valve 26 closed. The valve will remain closed even in high sea states involving low frequency oscillations because of the water retention and expansion characteristics of the sponges.

Obviously, many modifications and variations of the invention are possible in light of the above teachings. It is therefore to be understood that within the scope of the appended claims, the invention may be practiced otherwise than as specifically described.

What is claimed is:

1. An entrapped air floatation device for deployment of a non-buoyant object from an elevated position in air into a body of water, comprising, in combination:

an inflatable member formed to dependingly support the object and having an orifice formed therein for restricting fluid flow out of said member, for allowing sufficient air into said member during descent from the elevated position to provide adequate buoyancy for the object, and for allowing water into said member thereafter, said orifice being positioned below the air-water interface after the device reaches a floating position in the water; and water-actuated valve means registered with said orifice for sealing said orifice upon contact with the water allowed into said member;

whereby the air pressure attained in said member is prevented from escaping through the sealed orifice in high sea states producing low frequency oscillations.

2. An entrapped air floatation device according to claim 1 wherein said valve means further comprises:

actuating means operatively connected to said member in registration with said orifice for expanding toward said orifice when in contact with water; and sealing means operatively connected between said actuating means and said orifice and in registration therewith for sealing said orifice when said actuating means is fully expanded.

3. An entrapped air floatation device according to claim 2 wherein said sealing means further comprises:

a flexible seal operatively connected between said actuating means and said orifice and having an area larger than said orifice for covering and sealing thereof; and a rigid plate operatively connected to said member and concentrically attached to said seal, said plate having an area larger than said orifice and smaller than said seal for transmitting the force of said expanding actuating means to said seal for forcing said seal against said orifice.

4. An entrapped air floatation device according to claim 3 wherein said actuating means is a celluloid sponge.

5. An entrapped air floatation device according to claim 1 wherein said valve means further comprises:

housing means operatively attached to said member;

actuating means attached to said housing means in registration with said orifice for expanding toward said orifice when in contact with water; and sealing means operatively connected to said housing means between said actuating means and said orifice and in registration therewith for hingingly sealing said orifice when said actuating means is fully expanded.

6. An entrapped air floatation device according to claim 5 wherein said housing means further comprises:

first and second plates parallelly separated by a plurality of spacers for forming an opening therebetween, said first plate providing a surface formed to be attached to said actuating means for support thereof in said opening, and said second plate forming a ring sealingly registered about said orifice for providing a valve seat.

7. An entrapped air floatation device according to claim 6 wherein said sealing means further comprises:

a flexible seal operatively connected between said actuating means and said valve seat and having an area larger than said orifice for sealingly engaging said seat; and a rigid plate operatively connected to said member and concentrically attached to said seal, said plate having an area larger than said orifice and smaller than said seal for transmitting the force of said expanding actuating means to said seal for forcing said seal against said seat.

8. An entrapped air floatation device according to claim 7 wherein said actuating means is a celluloid sponge.

9. A check valve for stopping fluid flow through an orifice formed in a non-permeable member, comprising, in combination:

housing means having first and second plates parallelly separated by a plurality of spacers for forming an opening therebetween, said first plate forming a ring sealingly registered about the orifice for providing a valve seat;

actuating means connected to said housing means second plate and in registration with said orifice for expanding toward said orifice when in contact with water; and sealing means operatively connected between said actuating means and said orifice and in registration therewith for sealing said orifice when said actuating means is fully expanded.

10. A check valve according to claim 9 wherein said sealing means further comprises:

a flexible seal operatively connected between said actuating means and said valve seat and having an area larger than said orifice for sealing engaging said seat; and a rigid plate operatively connected to said member and concentrically attached to said seal, said plate having an area larger than said orifice and smaller than said seal for transmitting the force of said expanding actuating means to said seal for forcing said seal against said seat.

11. A check valve according to claim 10 wherein said actuating means is a celluloid sponge.

* * * * *